US005440966A

United States Patent [19]

Tellander et al.

[11] Patent Number: 5,440,966

[45] Date of Patent: Aug. 15, 1995

[54] MATERIAL HAND-OFF DEVICE AND PROCESS

[75] Inventors: Robert M. Tellander; Kenneth W. Hummel, both of Coon Rapids; Jeffrey F. Kezar, St. Paul, all of Minn.

[73] Assignee: FMC Corporation, Chicago, Ill.

[21] Appl. No.: 103,952

[22] Filed: Aug. 10, 1993

[51] Int. Cl.[6] ..... F41A 9/16

[52] U.S. Cl. ..... 89/46; 89/47

[58] Field of Search ..... 89/45, 46, 47

[56] References Cited

U.S. PATENT DOCUMENTS 3,218,930 11/1965 Girouard et al. ..... 89/45

4,481,862 11/1984 Wiethoff et al. ..... 89/46

OTHER PUBLICATIONS

Naval Ordnance, 1939, pp. 196–201.

*Primary Examiner*—Stephen C. Bentley

*Attorney, Agent, or Firm*—G. Wolde-Michael; R. C. Kamp; R. A. Andersen

[57] ABSTRACT

A material hand-off mechanism and process which utilizes a pendulating arm to deliver material to and or accept it from a load station which cooperatively engages the arm. The load station and the arm provide interceptive, interactive and linkless conveyance capable of independent and parallel operations to enhance efficiency and availability of the system. Particularly, the mechanism is suited to transfer ammunition from a storage station into a gun tube. The ammunition is rammed into the gun breech using a flick ram mechanism, which operates in cooperation with the arm, and enables a sure ram of ammunition comprising different modules.

7 Claims, 6 Drawing Sheets

FIG_5
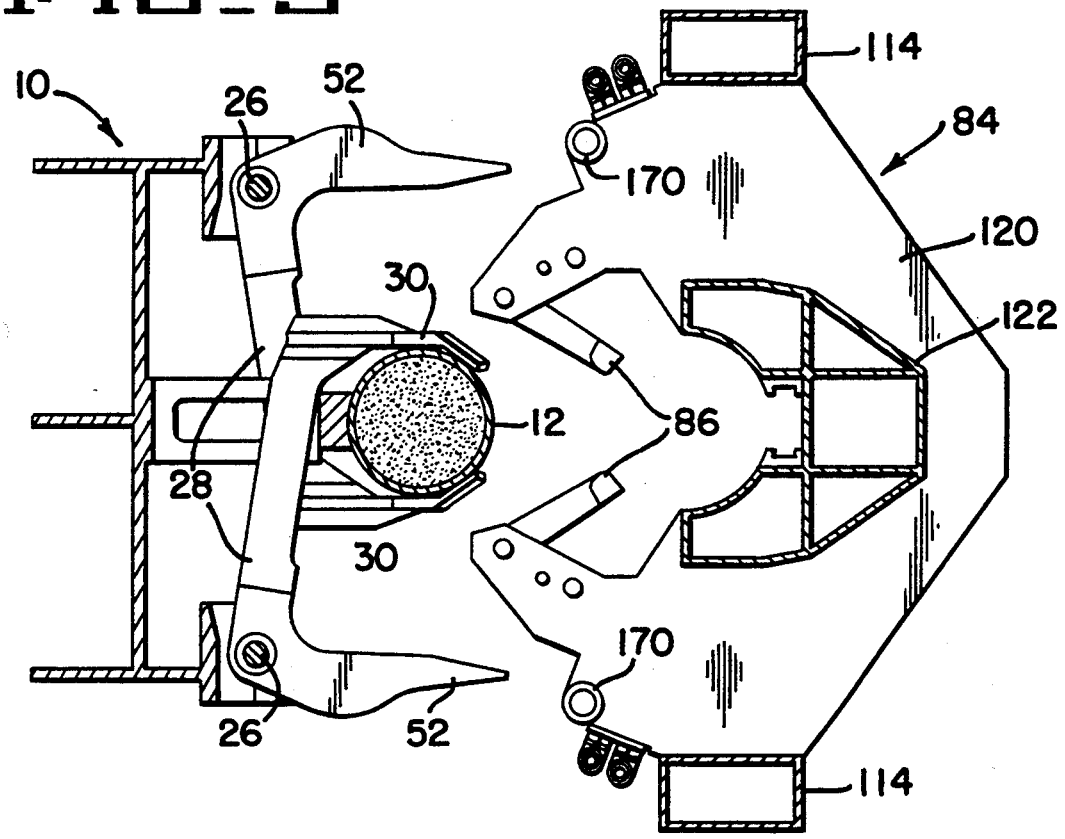
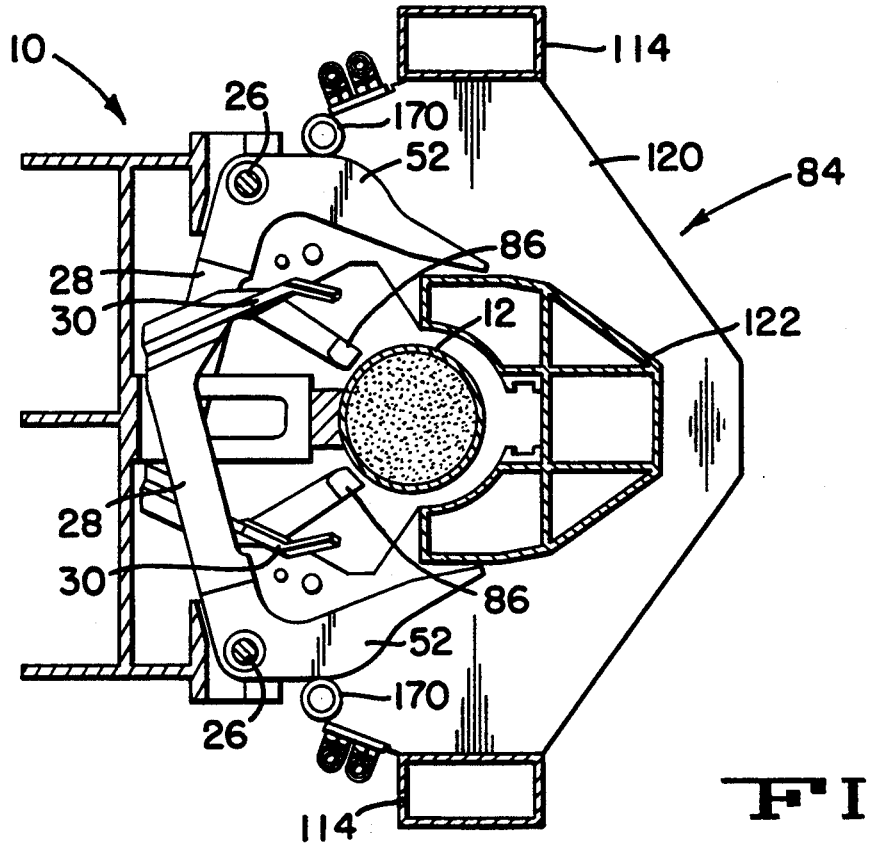
FIG_6

MATERIAL HAND-OFF DEVICE AND PROCESS

BACKGROUND OF THE INVENTION

FIELD OF THE INVENTION

This invention relates to material hand-off mechanisms and process. The present invention is particularly suited to transfer ammunition from a lower supply system to a gun tube. As applied to gun leading systems, the present invention provides enhancement in reliability, maintainability and performance while reducing gun system weight and cost.

SUMMARY OF THE INVENTION

The material hand-off device and process of the present invention enable efficient transfer of material from one handling system to another. The transfer process is complete when the handling systems reach specific end points. However, the transfer may be performed independent of the relative motion of each. The handling systems include a controlled pendulating or swinging system which engages a hoisting system. These two systems occupy one common end point. However, the motion profiles to the end points are independent. Generally, one of the handling systems is a structure which receives the material to be hoisted and releases the material into the pendulating system when engaged. The handling systems operate in parallel and provide structural support for the material in transit. This unique feature enables the system to be fast, reliable and structurally less cumbersome than existing systems having several operations which typically require heavy structures and take a longer time to transfer material.

BRIEF DESCRIPTION OF THE DRAWINGS

FIG. 5 is a cross-sectional view along section 5—5 of FIG. 3.

FIG. 6 is similar to FIG. 5 showing the preferred handling system and the cradle engaged.

DESCRIPTION OF THE PREFERRED EMBODIMENT

The material hand-off device and process of the present invention provides increased reliability and availability of material handling systems. Particularly, this disclosure relates to a cradle which operates in cooperation with a hoisting mechanism to transfer ammunition from a lower level to the gun breech tube. One of the most significant advances of the present invention includes an independent and parallel operation of the systems to promote efficiency in both response time and performance. The present invention is distinguished from earlier systems in as much as the material hand-off device and process provide a reliable and faster material handling media with reliable and faster material handling media having equally reliable structural support for the material in transit. Significantly, the present invention provides mechanisms for handling ammunition of different types including a reliable means for breech loading which combines a direct contact push and free fall deceleration elements. Accordingly, the problem of transferring materials using independently operable, parallel sequence and cooperative material handling systems is one of the many important points of the invention as will be discussed hereinbelow.

Figure 1:
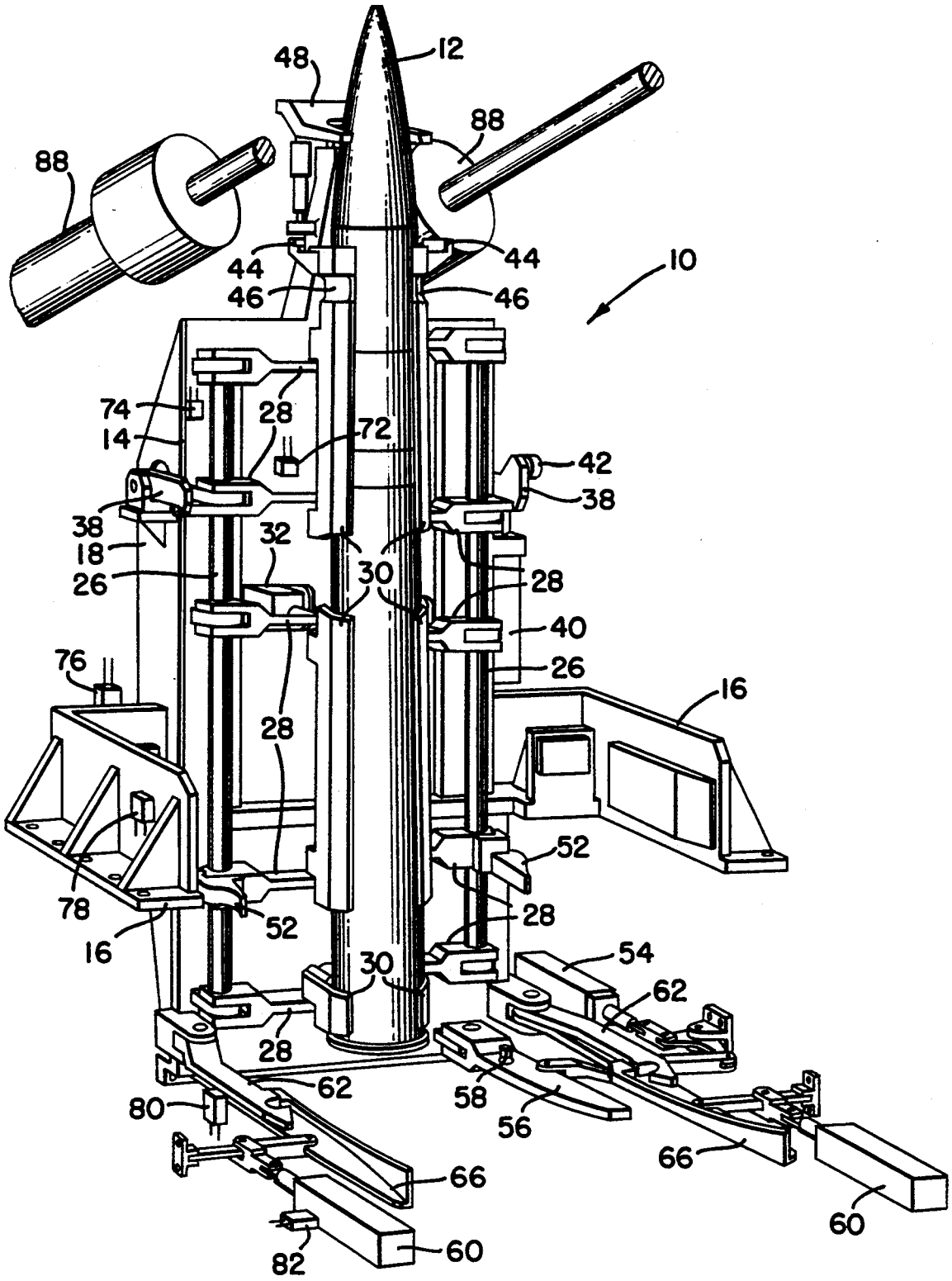
FIG. 1 is a perspective drawing of a material handling system depicting a hoisting system with an ammunition stowed therein.

An embodiment of the present invention is shown in FIG. 1 wherein material handling system or load station 10 is loaded with ammunition 12 in an upright position. Material handling system 10 comprises vertical plates 14 having lateral structural supports and attachments 16 and side plates 18. Connection rods 26 are movably connected to levers 28 at a first end. Levers 28 are rigidly connected to shutters 30 at a second end. Actuator 32 is attached to levers 28 to open and close shutters 30. Shutter latches 38 are operated by actuator 40. Shutter latches 38 are connected by a splined shaft. Load station shutter latches 38 include unlatched roller 42, which is externally attached thereon. Cradle shutter opening cams 44 and 46 are located at the uppermost end of load station shutters 30. An ammunition buffer structure 48 supports and acts as a brake to stop the material if it comes up fast through the load station 10. Load station shutter opening cams 52 are located at the lower end of the shutter connecting rods 26. Further, ammunition unload/position actuator 54 is located at the base to operate the ammunition unload/position arm 56. Unload pin 58 is fitted on the unload/position arm 56. Hoist latch actuators 60 activate the cradle to hoist latches 62, as well as the cradle shutter unlatch cams 66. The load station 10 includes a plurality of proximity switch sensors which provide the status of several mechanisms. Sensors 72 monitor status of load station shutters 30. Sensors 74 monitor shutter latches 38. Sensor 76 confirms if the cradle 84 (FIG. 2), is all the way down into the load station. Sensor 78 confirms presence of ammunition in the load station 10. Sensors 80 monitor status of cradle to hoist latches. Sensors 82 monitor status of the hoist latch actuators.

Figure 2:
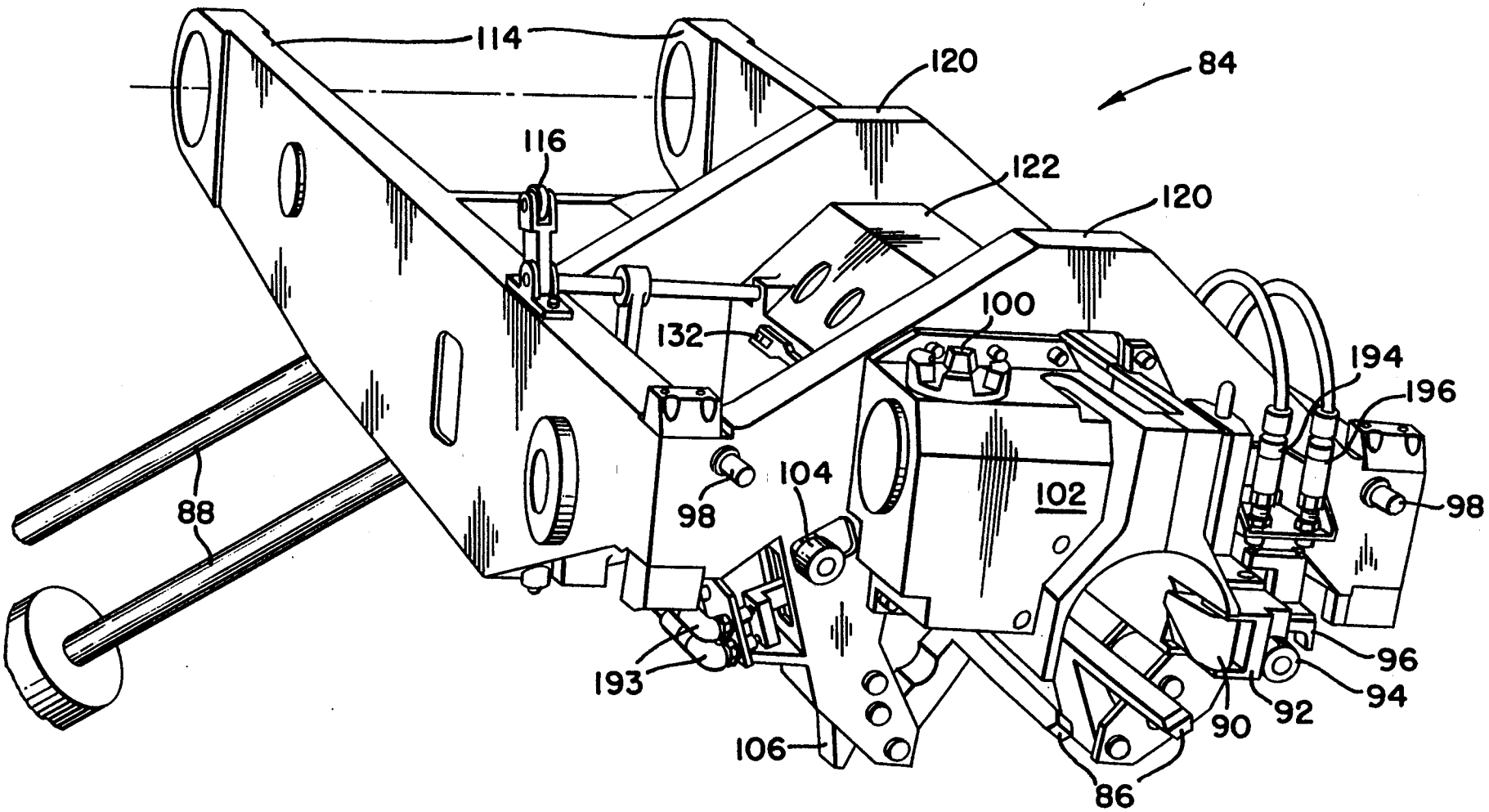
FIG. 2 is a perspective drawing of a cradle with pistons.

Referring now to FIG. 2, an embodiment of the present invention is shown wherein cradle 84, shown with 2 continuous shutters 86 in the closed position. Cradle 84 comprises drive pistons or actuators 88 (refer to FIG. 3 for connections) which effectuate and control the cradle 84 in a swinging motion, as will be discussed hereinbelow. Further, cradle 84 includes ammunition latch pawl 90 which is contained in latch pawl housing 92. Ammunition positioning cam roller 94 is also mounted to latch pawl housing 92. Cradle ammunition latch pawl link 96 is mounted contiguous to latch pawl 90. Cradle at hoist latch pins 98 latch onto cradle 84 when it is at hoist position. Crown gear 100 is contiguous to rammer gear box 102 which is located in the rear of the cradle 84. Cradle shutter unlatch rollers 104 (one of two shown in FIG. 2) are mounted to cradle shutter latches 106. Cradle structure arms 114 provide structural support for cradle components as shown. The forward most ends of the cradle structure arms 114 are also the pivot points for cradle rotation. Cradle ammunition restrainer disengage roller 116 is mounted on top of arm 114. Cradle structure cross supports 120 tie cradle arms 114 and cradle body 122 together, and provide structural support for cradle 84 components as shown. Extension pawl activator 132 is mounted on cradle body 122 in front of rear cross support 120 and will be discussed further hereinbelow. Similarly cradle 84 contains a plurality of proximity switch sensors which sense engagements and initiate the next stage in the material hand-off process. These sensors will be discussed further hereinbelow.

Figure 3:
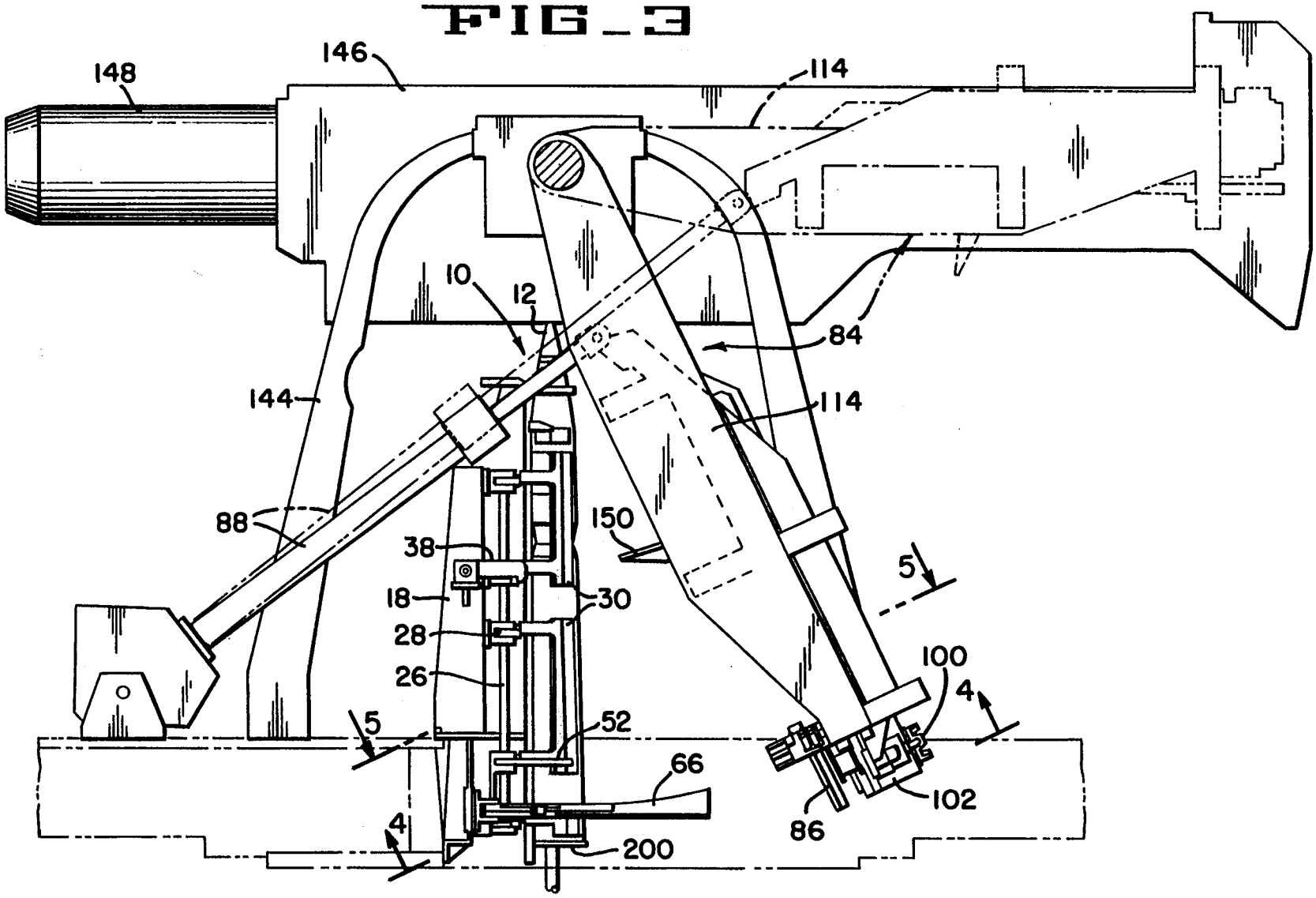
FIG. 3 is a side elevation view of the material handling system and the cradle in an initial stage before engagement.

Referring now to FIG. 3 which is a side view wherein load station 10 and cradle 84 are centrally located between two trunnion supports 144, cradle 84 is shown in position (phantom lines) in slide 146 which position is maintained to ram ammunition into the breech tube of gun. 148. Cradle 84 is also shown just before engaging load station 10 (solid lines). Load station shutter unlatch cam 150 is shown about to engage load station shutter unlatch roller 42. Platform 152 supports the entire upper gun assembly.

Figure 4:
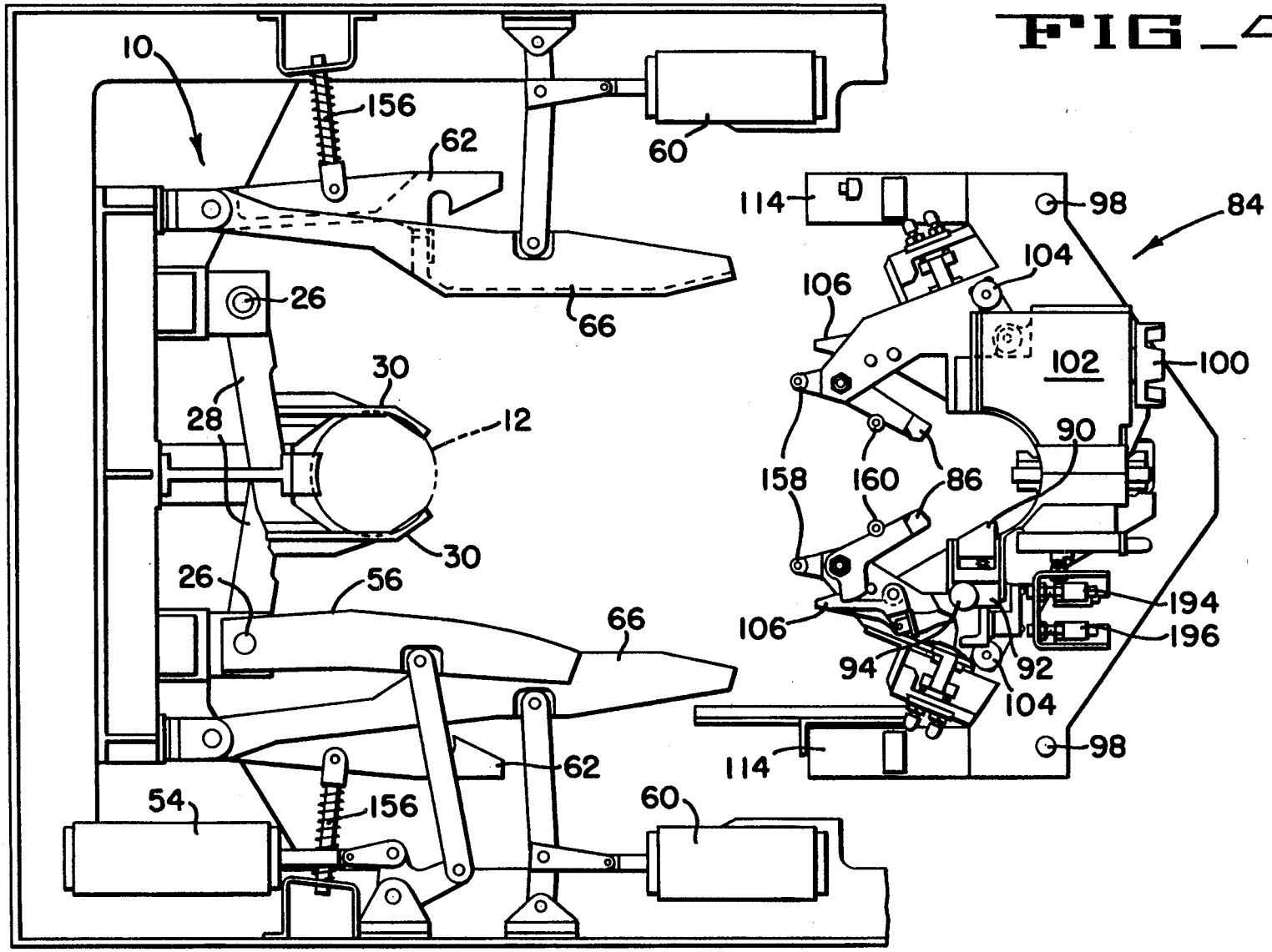
FIG. 4 is a view taken in the direction of arrows 4—4 of FIG. 3 depicting the cradle and the material handling system in an initial stage before engagement.

FIG. 4 is a bottom view of load station 10 and cradle 84. Load station 10 components include cradle to hoist latch springs 156 which provide resilience and support for cradle at hoist latches 62. During engagement of the cradle 84 to load station 10, cradle shutter primary opening rollers 158 are used to begin opening cradle shutters 86. Cradle shutter secondary opening rollers 160 are used to continue the opening of cradle shutters 86. Cams 44 and 46 (FIG. 1) are engaged by rollers 158 and 160 as described hereinbelow.

Figure 7:
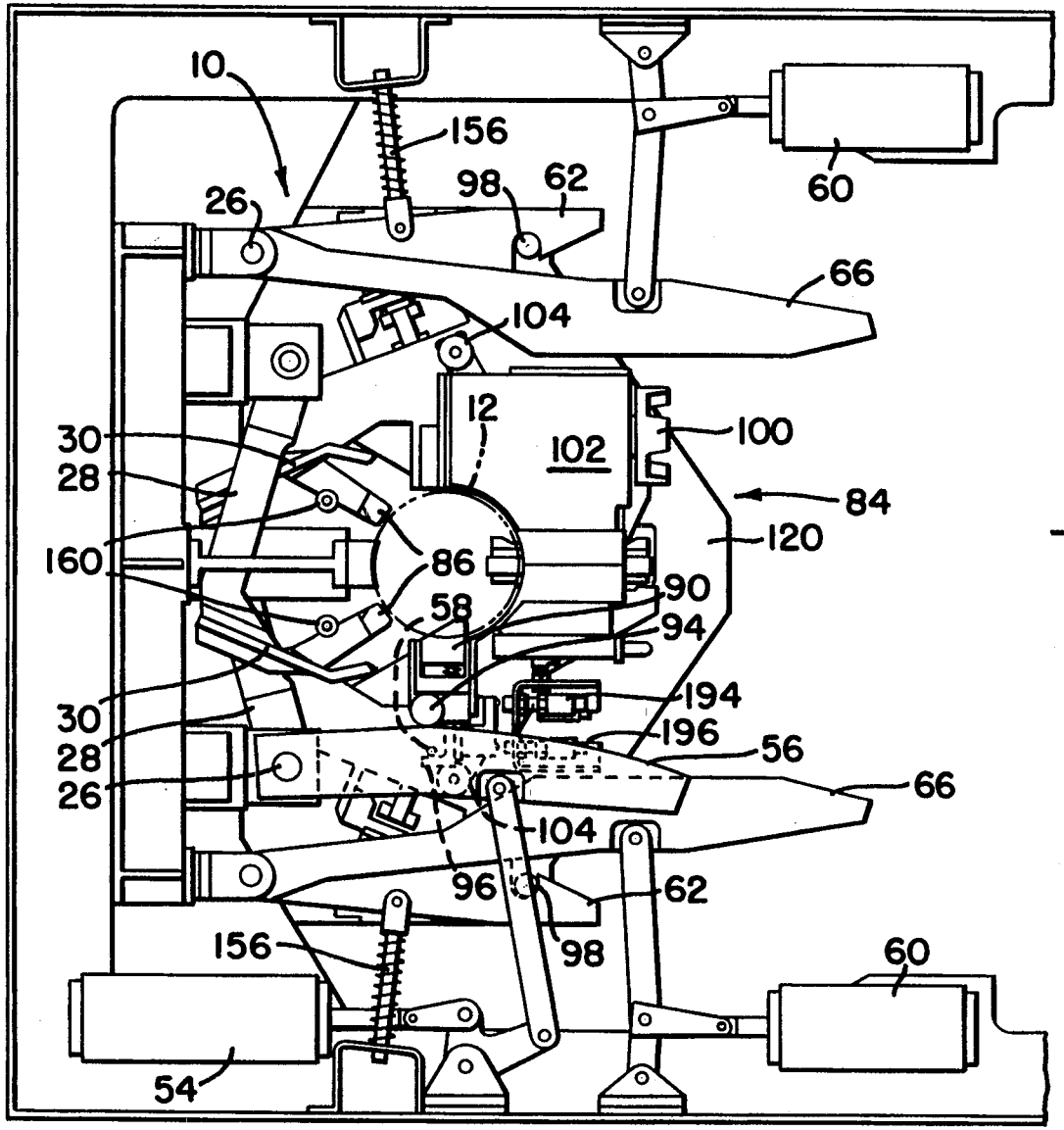
FIG. 7 is similar to FIG. 4 showing the material handling system and the cradle engaged.

Referring to FIGS. 1 and 7, mechanisms of the present invention cooperate to transfer ammunition from load station 10 to cradle 84 which is then transferred to a gun tube. Alternatively, cradle 84 can be used to transfer material directly as back to lower supply system. First, cooperation and function of the several components is discussed hereinbelow in light of an exemplary ammunition 12 (FIG. 1) transfer from load station 10 (FIG. 1) to cradle 84 (FIG. 2) and ultimately to gun tube 148 (FIG. 3). Initially cradle 84 is at slide 146 (FIG. 3). Further, load station 10 (FIG. 1) is closed ,i.e., load station shutters are positioned to accept ammunition from lower supply system. Transfer of ammunition 12 to cradle 84 is initiated by first checking electronic sensors to confirm system status and readiness. For example, sensors 72 (FIG. 1) confirm status of shutters 30 and sensors 74 (FIG. 1) confirm status of shutter latches 38. Also sensors 82 confirming the status of the cradle shutter unlatch cams 66.

In the preferred embodiment, the transfer of ammunition 12 (FIG. 1) begins by lowering cradle 84 (FIG. 2) by means of actuators or pistons 88 (FIG. 2) towards load station 10 (FIG. 1). A plurality of valves and buffing orifices (not shown) control the motion of cradle 84. Subsequently, when cradle 84 is oriented within a proximate distance of 10 degrees relative to load station 10 (FIG. 1) sequential and cooperative functions of several components are initiated as discussed hereinbelow. First, cradle shutter unlatch rollers 104 (FIGS. 2 and 4) contact shutter unlatch cams 66 (FIGS. 1 and 4) and pivot cradle shutter latches 106 (FIGS. 2 and 4) to unlatch cradle shutters 86 (FIGS. 2 and 4). Next, the cradle shutter primary opening rollers 158 (FIG. 4) contact load station shutter opening cams 44 (FIG. 1) and begin to pivotally open cradle shutters 86 (FIG. 2). When cradle shutters 86 are approximately 50% open, cradle shutter secondary opening rollers 160 (FIG. 4) would have contacted cradle shutter opening cams 46 to continue opening cradle shutters 86. Next, load station shutter unlatch cams 150 (FIG. 3) contact load station shutter unlatch roller 42 (FIG. 1) and pivot load station shutter latches 38 (FIG. 1) to thereby unlatch load station shutters 30 (FIG. 1). Then, the load station shutter opening rollers 170 (FIGS. 5 and 6) contact load station shutter opening cams 52 (FIGS. 5 and 6) to begin opening load station shutters 30 (FIG. 1). Load station shutter actuators 32 (FIG. 1) resist opening motion to prevent load station shutters 30 from slamming open. Further, cradle to hoist latch pins 98 (FIGS. 4 and 7) contact and pivot cradle to hoist latches 62 (FIGS. 4 and 7) to open against latch spring 156 (FIGS. 4 and 7). Just before cradle 84 is completely engaged into load station 10, the following sequence of events occur. Cradle shutter secondary opening rollers 160 (FIG. 4) ride off the cradle shutter opening cams 46 (FIG. 1). Then the cradle shutter closing springs (not shown) pivotally close cradle shutters 86 around ammunition 12 (FIG. 1). Once cradle shutters 86 are fully closed, cradle shutter latches 106 automatically engage. Simultaneously, cradle to hoist latch springs 156 (FIGS. 4 and 7) pivot cradle to hoist latches 62 inward to latch the cradle to hoist. At this juncture, cradle 84 is fully lowered and latched (FIG. 7). Sensors (not shown) within cradle 84 monitor status of ammunition 12, for example, ammunition 12 may still be hoisting from lower supply system.

Thereafter cradle 84 is fully lowered and latched. Ammunition 12 is controlled by cradle 84 and thus cradle 84 is allowed to begin raising. Prior to raising, however, various electronic sensors are checked for indication. The following sensors are critical before initiation of the cradle raise cycle and are used to verify that ammunition 12 has been transferred to the cradle. Sensors 193 (FIG. 2) indicate cradle shutters 86 are closed and latched; sensors 194 and 196 (FIG. 2) indicate cradle ammunition latch pawl 90 (FIG. 2) is extended behind ammunition, and sensors (not shown) within cradle 84 indicate ammunition is loaded into cradle 84. In order to raise cradle 84, load station shutter actuators 32 (FIG. 1) force and hold shutters 30 (FIG. 1) open. The position/unload actuator 54 (FIG. 1) retracts and pivots cradle position/unload arm 56 (FIG. 1). Cradle position/unload arm 56 contacts cradle position roller 94 (FIG. 2) thus pivoting cradle ammunition latch pawl housing 92. As cradle round latch pawl housing 92 pivots, cradle round latch pawl 90 (FIG. 2) raises thus lifting the ammunition to be transferred off hoist pawl 200 (FIG. 3). Cradle to hoist latch actuators 60 (FIG. 7) extend and pivot both cradle to hoist latches 62 and cradle shutter unlatch cams 66. At this point, cradle 84 is unlatched from the hoist position and cradle shutter unlatch cams 66 are out of the path of cradle shutter unlatch rollers 104 (FIG. 2). Further, the following sensors are checked. A sensor (not shown) checks position of cradle unload/position actuator 54 (FIG. 4). Sensors 82 (FIG. 1) check position of cradle to hoist latch actuators 58 (FIG. 1). Sensors 72 (FIG. 1) are checked to confirm shutters 30 are open. Also, sensors 194 and 196 (FIG. 2) are checked to see cradle ammunition latch pawl 90 (FIG. 2) is extended and positioned.

Hereafter, cradle 84 can be raised using cradle actuator 88. Cradle actuator 88 utilizes electro-hydraulic servo valve to control the motion of cradle 84 as it travels to be positioned in slide 146 (FIG. 3). When cradle 84 is at least 15 degrees away from the hoist position the cradle to hoist actuator 60 (FIG. 1) is extended to its center position, and cradle load station shutter actuator 32 (FIG. 1) is extended. Load station 10 is now in a closed position and ready to receive ammunition from lower supply system via hoist tube.

Accordingly, material is transferred from load station 10 to cradle 84. Subsequently, as will be discussed hereinbelow, the ammunition can be transferred from cradle 84 to gun tube 148 (FIG. 3). In the alternate, ammunition 12 may be transferred from cradle 84 back down into hoist tube. The process begins by preparing load station 10 such that loaded cradle 84 may be lowered into hoist tube position. Load station shutter latch actuator 40 (FIG. 1) is extended to pivot load station shutter latches 38 and to unlatch load station shutters 30. Load station shutter actuators 32 (FIG. 1) force and hold load station shutters 30 open. Cradle unload/position actuator 54 (FIG. 1) retracts and pivots cradle position/unload arm 56. Cradle to hoist latch actuators 60 extend and pivot both cradle to hoist latches 62 and cradle unlatch cams 66. At this point, cradle shutter unlatch cams 66 are out of the path of cradle shutter unlatch rollers 104 (FIG. 4). Initiating the cradle lower cycle includes checking load station shutters 30 (FIG. 1) status via sensors 72 (FIG. 1) and checking cradle unload/-position actuator 54 retracted status via sensors (not shown). The process continues by lowering cradle 84 with cradle actuator 88. Actuator 88 forces cradle 84 toward load station 10 and by use of valving and buffing orifices controls the motion of cradle 84. When cradle 84 gets to within 5 degrees of load station 10, cradle position/unload arm 56 (FIG. 1) contacts cradle ammunition position roller 94 (FIG. 2) thus pivoting cradle ammunition latch pawl housing 92. As cradle ammunition latch pawl housing 92 pivots, cradle ammunition latch pawl 90 raises thus lifting the ammunition above upper hoist pawl.

Cradle to hoist sensor 76 (FIG. 1) indicates that cradle 84 is fully lowered. Unloading of cradle 84 is then initiated. Cradle to hoist latch actuators 60 (FIG. 1) are then retracted thus allowing cradle to hoist latch springs 156 (FIG. 1) to pivot cradle to hoist latches 62 thus latching cradle down at hoist position. Simultaneously, cradle unload/position actuator 54 (FIG. 7) is fully extended thereby pivoting cradle position/unload arm 56 (FIG. 7) outward. During this operation cradle position/unload arm 56 is pivoted from cradle position roller 94 (FIGS. 7 and 2) thus allowing the cradle ammunition latch pawl housing 92 (FIG. 2) to spring back to the unpivoted position. This lowers cradle ammunition latch pawl 90 and thus the ammunition is lowered onto upper hoist pawl. Cradle unload/position actuator 54 continues to extend and thereby pivots cradle position/unload arm 56. This motion causes cradle unload pin 58 (FIGS. 1 and 7) to contact cradle ammunition pawl link 96 (FIGS. 2 and 7) and thereby retract cradle ammunition latch pawl 90 (FIG. 2) out from behind ammunition 12. Thus ammunition 12 is now being held by hoist tube pawl.

Prior to lowering the ammunition down into hoist tube, various sensors are checked. Cradle ammunition latch pawl retraction is confirmed via sensors 194 and 196. Also, cradle to hoist latch engagement is checked via sensors 80 (FIG. 1). Cradle 84 is now prepared for lowering ammunition down into hoist tube by lowering hoist pawl. When the ammunition is completely unloaded, cradle unload/position actuator 54 (FIG. 7) may be retracted to its center position thus returning cradle ammunition latch pawl 90 to its extended position. At this point cradle 84 remains latched at the hoist position and is ready to receive ammunition again from lower supply system.

As stated hereinabove, in the preferred embodiment cradle 84 delivers ammunition to slide 146 (FIG. 5) to be rammed into gun tube 148. The process begins by pivoting the loaded cradle 84 to slide 146. A slide mounted cradle ammunition restrainer release cam (not shown) is actuated thus contacting cradle ammunition restrainer roller 116 (FIG. 2) thus retracting the cradle ammunition restrainers from within the cradle ramming tube. A rammer drive (not shown) mounted in slide 146 (FIG. 3) is unlatched and enabled to provide ramming of ammunition. The ramming motion is provided by electro-hydraulic servo valve controlled hydraulic motor. This provides motion to ammunition by driving through rammer box 102 (FIG. 2) in cooperation with a continuous chain/pawl system (also within cradle body 122, FIG. 2). The chain system includes two pawls so the rammer system does not require retraction after ramming. Therefore, as one pawl does a ram, the other pawl indexes into position for the next and consecutive ram. The rammer power drive is mounted in slide 146 and couples to the rammer gear box as cradle 84 raises and latches to slide 146 (FIG. 3) through rammer coupling 100 (FIG. 2). The de-coupling design enables the rammer power drive and the rammer gearbox to have independent latching systems.

One of the unique aspects of the present invention o relative to ramming includes a "flick" ramming device. This method involves pushing the ammunition only part way to the breech face and relying on the ammunitions inertia to complete the ram. The rammer pawl disengages from the ammunition by rotating around the forward idler sprocket (not shown), located at the forward end of the cradle body 122 (FIG. 2). At this point, the ammunition continues toward the breech face under its own inertia. In case the ammunition is not successfully rammed and latched at gun tube breech face, the extension pawl will be activated to finish the ram. Extension pawl (not shown) is activated by pushing on the extension pawl activator lever 132 (FIG. 2), this is pushed down by a slide mounted extension pawl actuator (not shown). When the extension pawl activator has been pushed, the extension pawl is lowered into the cradle ramming tube behind the ammunition. This allows the servo-hydraulic rammer pawl to push the extension pawl forward to the breech face thus completely ramming the ammunition into gun tube. Once the ammunition is fully rammed an "ammunition at breech face" latch (not shown) is engaged and confirmed via an ammunition at breech sensor (not shown). When such a ram condition is indicated the extension pawl is retracted back into cradle ramming tube by reversing the electro-hydraulic rammer, and raised out of the ramming tube into its stowage pocket by retracting extension pawl actuator (not shown). Sensors (not shown) confirm if extension pawl is in its stowage pocket and the servo-hydraulic rammer is then indexed back to its latched position.

Accordingly, the present invention provides a material hand-off and transfer mechanism and process which is flexible and accepts and or delivers the material by handing-off interceptively without a direct conveyance link. Both load station 10 and cradle 84 can either operate independent of each other or cooperate to perform a desired function. Particularly, the present invention is suited to operate as an ammunition transfer mechanism and process which can be used to load and unload a gun system. More particularly, an extension pawl system enables reliable ramming of different size ammunition into a gun breech thereby making the system universally adaptable to handle ammunition of different sizes.

It should be recognized that while the present invention has been described by reference to the preferred embodiment thereof, those skilled in the art may develop a wide variation of structural details and methods without departing from the principles of the present invention. Therefore, the appended claims are to be construed to cover all equivalents falling within the true scope and spirit of the invention.

What is claimed is:

1. A material hand-off mechanism comprising a load station and an indexable cradle structure to engage the load station comprising:

the load station including:

a vertically oriented structure with vertical plates and side plates having lateral structural supports and attachments tied to said lateral structural supports and said side plates;

a plurality of shutter latches attached to said vertically oriented structure;

a plurality of connection rods having an intermediate section, a first arid a second end connected to said shutter latches;

said plurality of connection rods movably connected to a plurality of levers at said intermediate section, said first end and said second end;

said plurality of levers rigidly connected to a plurality of shutters which support ammunition;

a roller externally attached to one of said plurality of levers;

a plurality of cradle shutter opening cams attached to said plurality of shutters which support ammunition;

an ammunition buffer structure attached to said vertically oriented structure to support and act as a brake to stop ammunition;

a plurality of cams attached to said levers at said intermediate sections of said plurality of connection rods;

ammunition unload and position cam movably attached to said vertically oriented structure;

an unload pin disposed on said ammunition unload and position cam;

an actuator to drive said ammunition unload and position cam;

a plurality of cradle to hoist latches movably attached to said vertically oriented structure;

a plurality of cradle shutter unlatch cams connected to said plurality of cradle to hoist latches; and means for actuating said plurality of cradle shutter unlatch cams and said plurality of cradle to hoist latches;

the indexable cradle structure independently operable to engage the load station including:

a structure having an adjustable opening for ammunition stowage including drive pistons to index the cradle structure;

a plurality of continuous shutters forming an opening therebetween within said structure;

an ammunition latch pawl contained in a housing and disposed at said opening for ammunition stowage;

ammunition positioning cam roller mounted to said housing;

a cradle ammunition latch pawl link mounted contiguous to said ammunition latch pawl;

said cradle structure having an external structure with front and rear cross supports;

a structure containing said cradle disposed between said front and rear cross supports;

a plurality of latch pins attached to said front cross support;

a crown gear attached to said front cross support;

a rammer gear box disposed contiguous to said crown gear;

a plurality of cradle shutter latches attached to said plurality of continuous shutters;

a plurality of cradle shutter unlatch rollers mounted to said plurality of cradle shutter latches;

a plurality of cradle structural arms integrally connected to said front and rear support structures; and said plurality of cradle structural arms further connected to said drive pistons to indexably move the cradle structure to engage the load station.

2. The material hand-off mechanism of claim 1 wherein an ammunition restrainer disengage roller is mounted on top of one of said plurality of cradle structural arms.

3. The material hand-off mechanism of claim 1 wherein an extension pawl activator is mounted in front of said rear cross support.

4. The material hand-off mechanism of claim 1 wherein said plurality of cradle structural arms are swingably supported at trunnion supports.

5. A method of loading and unloading ammunition between a load station and a cradle structure to engage the load station and transfer the ammunition to ram into the breech tube of a gun comprising the steps of:

indexing the cradle structure within a proximate distance of 10 degrees relative to the load station;

creating contact between cradle shutter unlatch rollers and unlatch cams and pivoting cradle shutter latches to thereby unlatch cradle shutters;

creating contact between cradle shutter primary opening rollers and load station shutter opening cams to pivotably open said cradle shutters;

creating contact between cradle to hoist latch pins and cradle to hoist latches to pivot said cradle to hoist latches to thereby open against latch springs just before the cradle structure is completely engaged into the load station; and lowering the cradle structure and simultaneously pivoting said cradle to hoist latches inward to latch the cradle to the load station.

6. The method according to claim 5 further including verifying that the ammunition has been transferred to the cradle structure using a signal from a plurality of sensors.

7. The method according to claim 5 wherein after said lowering of the cradle structure, the ammunition is controlled by the cradle and the cradle is raised to ram the ammunition into the breech of the gun.

* * * * *